United States Patent [19]

Burandt

[11] 4,438,737

[45] Mar. 27, 1984

[54] APPARATUS AND METHOD FOR CONTROLLING THE VALVE OPERATION OF AN INTERNAL COMBUSTION ENGINE

[75] Inventor: Corliss O. Burandt, Plymouth, Minn.

[73] Assignee: Investment Rarities, Incorporated, Minneapolis, Minn.

[21] Appl. No.: 310,510

[22] Filed: Oct. 13, 1981

[51] Int. Cl.[3] ..... F01L 1/34

[52] U.S. Cl. ..... 123/90.17; 123/90.31; 123/90.44

[58] Field of Search ..... 123/90.15, 90.16, 90.17, 123/90.18, 90.27, 90.31, 90.39, 90.44

[56] References Cited

U.S. PATENT DOCUMENTS

| | | | |
|---|---|---|---|
| 3,157,166 | 11/1964 | MacNeill | 123/90.16 |
| 3,441,009 | 4/1969 | Rafanelli | 123/90.15 |
| 3,496,918 | 2/1970 | Finlay | 123/90.15 |
| 3,641,988 | 2/1972 | Torazza et al. | 123/90.16 |
| 3,897,760 | 8/1975 | Hisserich | 123/90.18 |
| 3,986,484 | 10/1976 | Dyer | 123/90.16 |
| 4,280,451 | 7/1981 | Moore | 123/90.15 |

FOREIGN PATENT DOCUMENTS

| | | | |
|---|---|---|---|
| 1216864 | 4/1960 | France | 123/90.27 |
| 2265981 | 10/1975 | France | 123/90.16 |

*Primary Examiner*—Craig R. Feinberg
*Assistant Examiner*—W. R. Wolfe
*Attorney, Agent, or Firm*—Peterson, Palmatier, Sturm, Sjoquist & Baker, Ltd.

[57] ABSTRACT

A rotatable cam and pivotally mounted rocker arm are employed for each valve of an internal combustion engine. The rocker arm has a working or cam follower surface thereon which includes a straight section and a curved section. By relatively moving the cam and rocker arm so that the cam acts against appropriate portions of the cam follower surface, the moment of valve opening and closing is controlled, as well as the lift and duration of valve opening. The invention makes possible what is herein termed a five-cycle operation in that the following sequence can be achieved: (1) intake, (2) decompression, (3) compression, (4) power, and (5) exhaust.

17 Claims, 13 Drawing Figures

APPARATUS AND METHOD FOR CONTROLLING THE VALVE OPERATION OF AN INTERNAL COMBUSTION ENGINE

CROSS-REFERENCE TO RELATED APPLICATION

My copending application titled "Variable Valve Operating Mechanism for Internal Combustion Engines", Ser. No. 310,655, filed on Oct. 13, 1981, now U.S. Pat. No. 4,414,931, contains subject matter related to this application.

BACKGROUND OF THE INVENTION

1. Field of the Invention

This invention relates generally to internal combustion engines, and pertains more particularly to apparatus for determining the time the valves open and close, as well as the amount of lift and the duration of valve opening.

2. Description of the Prior Art

A relatively large number of mechanisms have been devised for controlling the opening and closing of inlet and exhaust valves for internal combustion engines. In this regard, some are quite simple, but perform only one function, such as controlling the height of valve opening, frequently referred to as the valve lift. Others have controlled the period or duration of valve opening without varying the lift.

One relatively early patent which depicts a mechanism for adjusting only the valve lift is U.S. Pat. No. 1,395,851, issued Nov. 1, 1921, to Francis B. McLean for "Valve Operating Mechanism". The effective moment arm or leverage for affecting the opening of the valve is derived from a rocker arm that is pivotally mounted intermediate its ends, the fulcrum or pivot point being shiftable in order to vary the amount of valve lift produced by the valve cam.

A patent depicting a mechanism that determines both the amount of valve lift and the time that the valve remains open is found in U.S. Pat. No. 2,412,457, issued on Dec. 10, 1946 to Laurence D. Harrison for "Valve Actuating Mechanism". The mechanism employs a profiled or contoured adjusting lever or rocker arm that is shifted relative to the valve to be opened and closed. However, the control of the lift and duration are integrated with each other and one cannot be realized in practice without affecting the other. Here again, the predominant change is in the duration, the correlated change in lift being quite minimal.

For the most part, prior art devices for varying the valve lift are indeed quite complicated and relatively costly. Furthermore, some of the devices with which I am acquainted contain parts that are vulnerable to wear with the consequence that their lift span is unduly short. In such instances, the owner would be confronted with the likelihood of frequent and costly repairs, thereby militating against the adoption of such valve actuating mechanisms.

SUMMARY OF THE INVENTION

It is an object of my invention to provide apparatus that will progressively cause a desired change in valve lift followed by a desired change in the duration that the valve is open.

Another object of the invention is to control the valve timing so that the valves open earlier or later, as well as closing earlier or later, depending upon load conditions to which the internal combustion engine is subjected.

A more specific object of the invention is to increase the valve lift to a practical maximum before increasing the duration or period that the valve remains open. A further object of my invention is to provide apparatus for operating internal combustion engine valves that will reliably change the valve opening and closing sequence from a fuel efficient (thermally efficient) cruise or normal operating mode to a mechanically efficient (volumetrically efficient) operating mode, doing so rapidly. Hence, it is an aim of the invention to enable the vehicle to travel under cruise conditions, where the load requirements are relatively light, and to effect a change rapidly when the load to which the engine is subjected requires a substantial increase, such as when undergoing acceleration or during other abnormal load situations.

A further object of the invention is to make substantial use of conventional parts. In this regard, the valve arrangement normally utilized in connection with internal combustion engines can remain unchanged. Even the camshaft and the cams thereon can be of conventional types. However, it is an aim of the invention to shift the camshaft in a linear direction so that the cams thereon bear against working or cam follower surfaces on rocker arms that follow the valve lift and valve duration in accordance with the shifted position of the camshaft at any given moment.

Still another object of the invention is to provide apparatus for controlling the opening and closing of internal combustion engine valves that will be rugged, longlasting and require little maintenance.

Still further, an object of the invention is to provide variable valve operating apparatus that can be used in combination with conventional sensing devices. In this regard, my invention lends itself readily to being controlled by a conventional vacuum device, such as a diaphragm connected to the intake manifold of the internal combustion engine, and to a speed-responsive device such as a governor that is driven in accordance with the engine's speed.

It is also an object of the invention to control the valve opening and closing pattern in such a manner that the intake valve is closed early or later during the intake stroke of the piston, thereby causing a lesser charge or mixture of fuel and air to be inducted into the cylinders or combustion chambers when the engine is subjected to light loads, yet permitting the amount of fuel and air to be increased when load conditions increase. Stated somewhat differently, an aim of the invention is to provide what might be termed a five cycle operation of an internal combustion engine in contradistinction to the more common four cycle operation. More specifically, it is planned that the five cycle operation will consist of a variable intake stroke, a variable expansion stroke (which continues for the remainder of the period that would normally constitute the intake stroke), a compression stroke, a power stroke and an exhaust stroke.

For a general object, it can be stated that my invention enables a number of controls to be exercised with respect to the opening and closing of the valves of internal combustion engines, whether they be inlet or exhaust valves, and which will also provide a control of the time at which the valves begin to open and the time that they close. Also, the amount of charge taken into each cylinder of the internal combustion engine can be controlled so as to induce a smaller charge to enter the cylinders when the engine is operating under light loads, yet causing a much greater charge to be drawn into the cylinders when power requirements increase.

Briefly, my invention makes use of a camshaft that is rotatable about a laterally shiftable axis. The cams on the camshaft bear against rocker arms having cam surfaces configured so as to change the valve lift during the initial lateral movement of the camshaft in one direction and to change the duration that the valves are open when additional movement in the same lateral direction is imparted to the camshaft. This is accomplished by using a rocker arm for each valve to be actuated. The rocker arm has a working or cam follower surface thereon which includes a straight section and a curved section. By laterally shifting the camshaft so that each cam thereon bears against the straight section, only the amount of valve lift is changed, yet when the camshaft is moved sufficiently farther so that the cams thereon bear against the curved section of the working surface, the duration or time that the valves are open is increased. The moment at which the valves start to open, and the moment at which they close, can be adjusted or indexed independently of the lateral position of the camshaft.

DESCRIPTION OF THE PREFERRED EMBODIMENT

Figure 1:
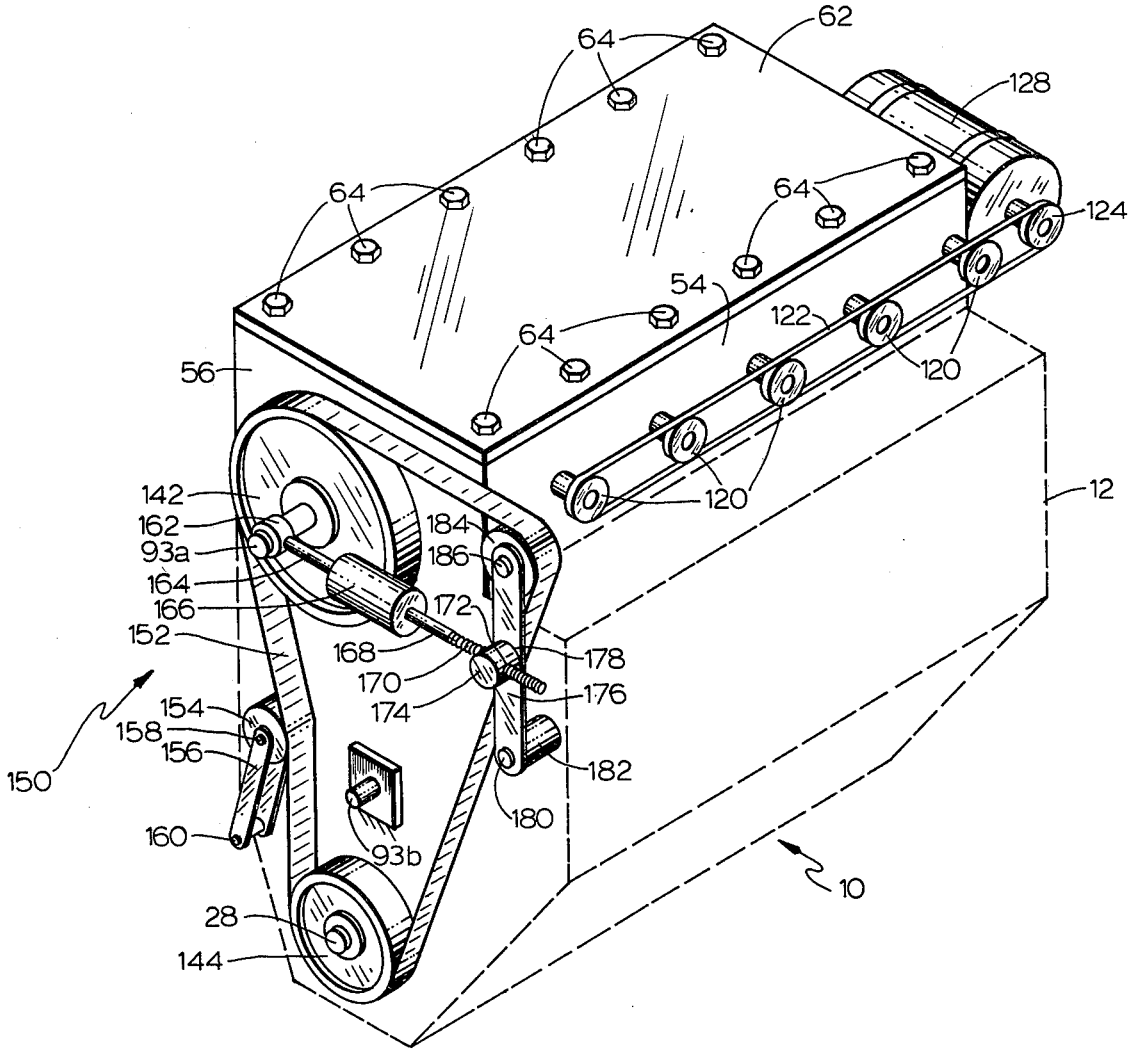
FIG. 1 is a diagrammatic view of an internal combustion engine in block form utilizing my valve controlling apparatus and timing.

It will be observed from the drawings that a conventional internal combustion engine 10 has been shown in a highly diagrammatic form in FIG. 1. As better appreciated from FIGS. 3 and 4, the engine 10 comprises a cylinder block 12 containing a combustion chamber 14 therein, the chamber 14 being one of any number of such cylinders. Overlying the cylinder block 12 and secured thereto is a cylinder head 15.

Figure 2:
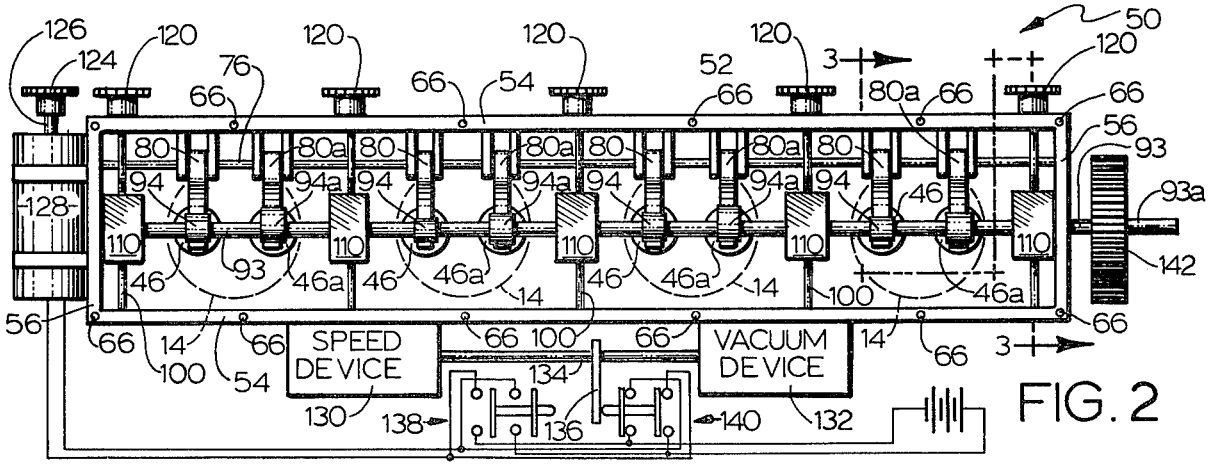
FIG. 2 is a top plan view corresponding to FIG. 1 but without the valve cover thereon and without the timing mechanism included.

As can be learned from FIG. 2, the combustion chamber 14 constitutes one of four such combustion chambers or cylinders. The combustion chamber or cylinder 14 that appears fragmentarily in FIGS. 3 and 4 has also been shown in FIGS. 5, 6, 6A, 7, 7A and 8–11, together with a piston 16 reciprocably movable within the cylinder 14.

Although more will be said with respect to FIGS. 5–11 when considering the manner in which my invention permits the engine 10 to be operated, it will be well at this stage to refer to the piston labeled 16 and the means via which it is vertically reciprocated within the combustion chamber or cylinder 14. In this regard, a wrist pin 18 connects the piston 16 to the upper end of a connecting rod 20 that has a bearing 22 at its lower end which encircles a crankpin 24 that is eccentrically mounted on a crankarm in the form of an eccentric 26 in the illustrative situation, the crankarm or eccentric 26 being mounted on a crankshaft denoted by the reference numeral 28. The piston 16 and the parts 18-28 subjacent thereto are of conventional construction, being common to all internal combustion engines. It is the manner in which my valve operating apparatus coacts in a timed relation with the movement of the piston 16 that is important and which will hereinafter be discussed in detail.

Figure 3:
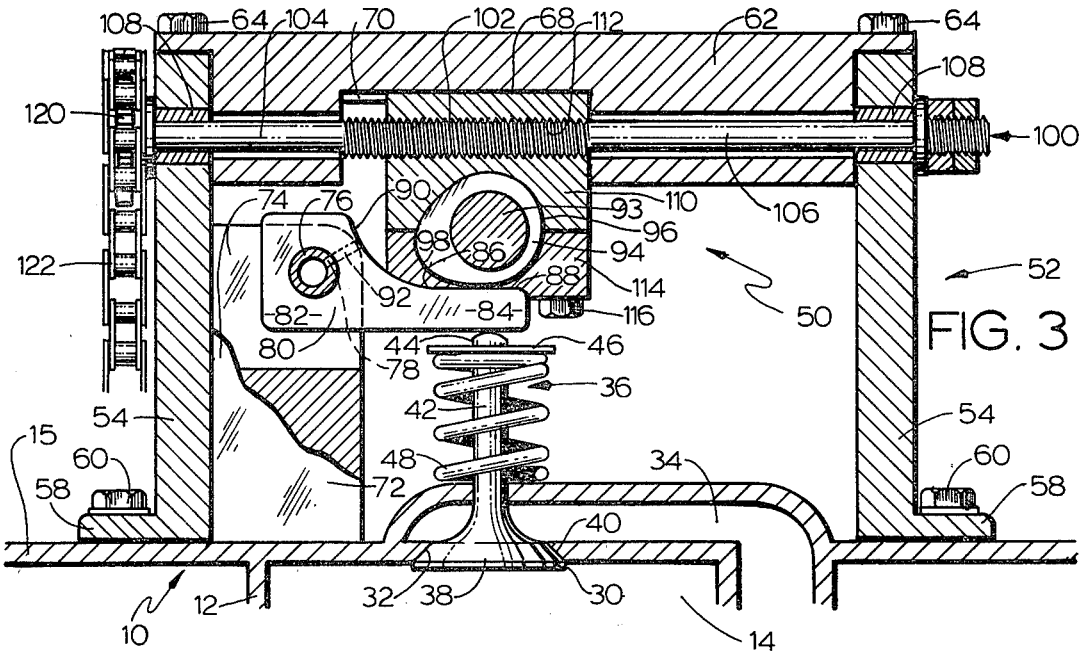
FIG. 3 is a greatly enlarged sectional view taken in the direction of the irregular line 3—3 of FIG. 2, the view showing the camshaft in one position and with the inlet valve actuated thereby closed.
Figure 4:
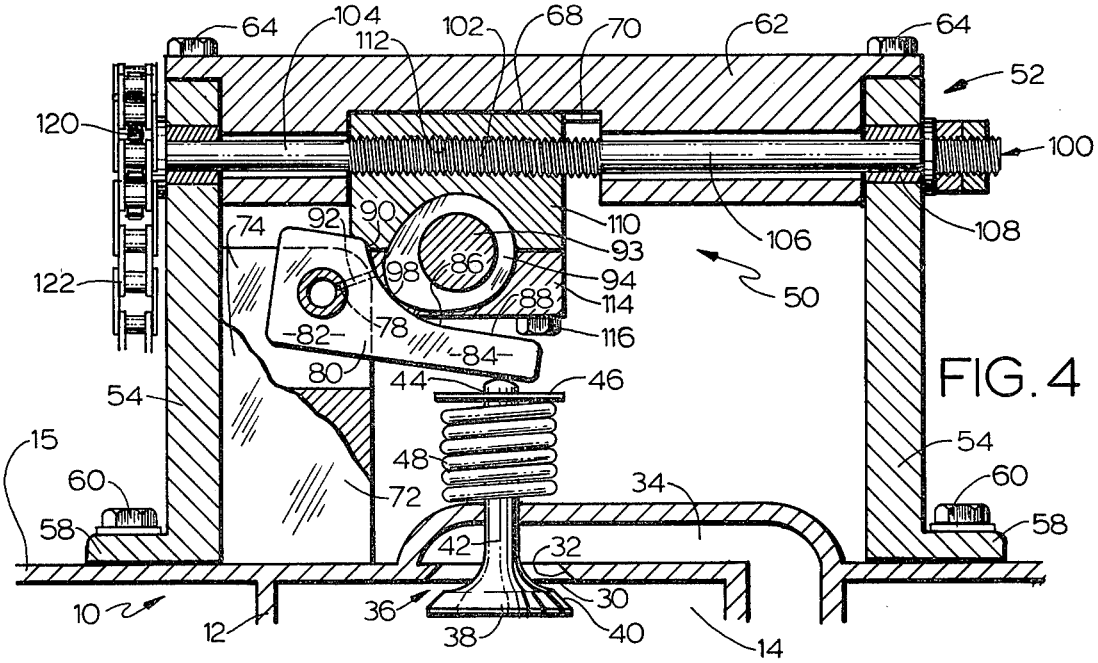
FIG. 4 is a view corresponding to FIG. 3 but with the camshaft shifted and the valve open.

From FIGS. 3 and 4, it will be discerned that there is a valve port 30 formed by a downwardly facing beveled seat 32. For the sake of simplicity, it will be considered that the valve port 30 constitutes an intake opening. Therefore, a passage 34 extends to the opening or port 30 from the intake manifold (not shown) of the engine 10 to supply a charge or mixture of fuel and air to the cylinder 14.

Also, conventionally included is a valve 36 having a valve head 38 at its lower end, the valve head 38 being beveled at 40 so as to seat against the beveled seat 32. Extending upwardly from the head 38 is a stem 42. Formed in the upper end portion of the stem 42 is an annular groove at 44 for anchoring a washer-like retainer 46. A coil spring 48 acts against the retainer 46 to normally close the valve 36. It should perhaps be mentioned that the inlet valve 36 of FIGS. 3 and 4 also appear in FIGS. 5–11 and that the exhaust valve labeled **36*a* also appears in FIGS. 5–11, being shown in phantom outline to distinguish it from the inlet valve 36 which is illustrated in solid outline. It might be well to label the retainers on the exhaust valves 36*a* (not visible in FIG. 2) as 46*a* so as to denote the locations, in a general way, of the valves 36*a***.

It should be made clear at this time that the foregoing description has dealt with parts of a conventional internal combustion engine 10. Because of this, it has not been necessary to go into any great detail, resort having been made to showing the parts in a highly diagrammatic form.

Turning now to a description of parts that coact with the conventional parts that have been described, and which parts comprise my invention, it will be pointed out that the valve operating apparatus selected to exemplify my invention has been indicated generally by the reference numeral 50. The apparatus 50 includes a valve housing denoted in its entirety by the reference numeral 52. The valve housing 52 includes side walls 54 and end walls 56. The side walls 54 are formed with hold-down feet 58 which are anchored to the cylinder head 15 by means of bolts 60. A specially configured lid 62 is held in place by bolts 64 which extend downwardly into tapped holes 66 in the side walls 54, the tapped holes 66 being visible in FIG. 2; in this regard, the lid 62 has been removed in FIG. 2 in order to show parts of my apparatus 50 that would otherwise be concealed. The specially configured lid 62 has a groove 68 extending partially across its underside, the groove 68 performing a guiding function presently to be made clear. At this time, it will be pointed out that the groove 68 may have one or more ribs 70 therein so as to assist in the guiding action yet to be described.

Secured to the inner face of the left side wall 54, as viewed in FIGS. 3 and 4, is a support block 72. The support block 72 may be secured to the inner face of the left wall 54 by bolts or by welding, neither of which is illustrated. Extending upwardly from the block 72 are a pair of upstanding ears 74, there being two such ears 74 for each valve 36, **36*a* to be actuated. A tubular shaft 76 extends through all of the upstanding ears 74, (see FIG. 2) the shaft 76 having a radially directed oil hole 78. In practice, it is intended that one end of the tubular shaft 76** be connected to an oil supply (not shown) so that oil can be delivered therethrough for lubricating purposes presently to be explained.

There is a rocker arm 80 for each inlet valve 36 and a rocker arm **80*a* for each exhaust valve 36*a*. The rocker arms 80 and 80*a* need not be identical, although they are similar. Of course, each rocker arm 80 would be a replica of the other, as would each rocker arm 80*a***.

With respect to the rocker arm 80, as shown in FIGS. 3 and 4, it can be seen that one end 82 thereof is pivotally mounted on the previously mentioned tubular shaft 76. The other end 84, which is the free end, acts against the upper end of the valve stem 42. In practice, a pad (not shown) can be pivotally carried or mounted to the free end 84 so as to bear against the upper end of the valve stem 42. However, an exemplary pad arrangement is depicted in my copending application titled "Variable Valve Operating Mechanism for Internal Combustion Engines", herein identified as a related application.

The upper side of each rocker arm 80, and also the upper side of each rocker arm **80*a*, is formed with a working or cam follower surface denoted generally by the numeral 86. More specifically, the contact surface 86 includes a straight section 88 and an upwardly curving or non-linear section 90, the section 90 having an oil hole 92 formed therein which communicates with the oil hole 78 in the tubular shaft 76. Thus, when oil under pressure is forced through the tubular shaft 76, some of the oil is discharged through the oil holes 78 and 92 onto the upwardly curving section 90 of the working surface 86. For the sake of drafting simplicity, the surface 86 has not been shown as having a channeled or grooved cross section. However, it is preferred that the entire contact or working surface 86** be channeled or grooved in actual practice, such as that shown in my copending application, supra.

Although the camshaft is basically of conventional construction, the manner in which it is mounted is believed to be unique. First, though, it should be explained that the camshaft, identified generally by the reference numeral 93 carries thereon a number of cams 94, **94*a*, there being one such cam 94 for each inlet valve 36 and a cam 94*a* for each exhaust valve 36*a* to be actuated. From FIG. 2, since there are four cylinders 14, and hence four rocker arms 80 and four rocker arms 80*a*, there will be a total of eight cams (four labeled 94 and four labeled 94*a*). One cam 94 appears in FIGS. 3 and 4. It will be observed that it has a circular base portion 96 and a lobe portion 98. The profile or edge of the cam 94, composed of the portions 96 and 98, bears against the working surface 86, composed of the follower sections 88 and 90, formed on the upper side of the rocker arm 80. Depending upon the position of the camshaft 93, the cam profile 96, 98 will bear against the straight section 88 or the upwardly curved section 90**.

Describing now the manner in which the camshaft 93 is mounted so that its axis of rotation can be shifted in order to cause the cam 94 to bear against selected portions of the working or contact surface 86 formed on the upper side of the rocker arm 80, it will be perceived from FIG. 2 that there are five shafts indicated generally by the reference numeral 100. The number of shafts 100 is susceptible to variation. What is required is that the entire camshaft 93, that is throughout its complete length, be shifted laterally in a manner so that its axis of rotation remains parallel to the pivotal axis provided by the tubular shaft 76 for the rocker arms 80, **80*a***.

Although the line 3—3 in which FIG. 3 is taken as far as FIG. 2 is concerned is irregular, it aptly pictures the valve actuation that is produced when employing my invention; the directional line 3—3 in FIG. 2 produces FIG. 4, as well as FIG. 3. With this in mind, it will be noted from FIGS. 3 and 4 that the shaft 100 there appearing has a central or intermediate threaded section 102 and two unthreaded sections 104, 106. The unthreaded sections 104, 106 are journaled for rotation in sleeve bearings 108 mounted in the side walls 54. The threaded section 102 extends through a block 110 having a threaded bore 112. Since there are five shafts 100, there are five blocks 110. Each block 110 forms one bearing for the camshaft 93. In this regard, each block 110 has a retention plate 114 secured to its underside by reason of holding bolts 116 that extend upwardly into the block 110 in each instance. Although not shown, it will be appreciated that the bearings that journal the camshaft can be split sleeve bearings, one-half residing in the lower portion of the block 110 that has a semicircular recess and the other half residing in a semicircular recess in the retention plate 114.

The groove 68 in the underside of the lid 62 has already been briefly mentioned. It should be clear, though, that the groove 68 guides the block 110 laterally back and forth. When a rib 70 is used, then the upper face of the block 110 would be correspondingly grooved to accommodate such a rib 70 (or ribs 70). In other words, the block 110 is constrained to move transversely or laterally depending upon the direction in which its shaft 100 is rotated.

The unthreaded sections 104, 106 of each shaft 100 are journaled for rotation in sleeve bearings 118, there being one contained in each side wall 54. From FIG. 2, it will be perceived that each shaft 100 has a sprocket 120 thereon. The various sprockets 120, and there are five in the exemplary situation, are driven through the agency of a chain 122 entrained about a drive sprocket 124 that is on the shaft 126 of an electric motor 128 at one end of the engine 10. All that need be appreciated at this time is that when the motor 128 is energized for operation in one rotative direction, the threaded section 102 of each of the shafts 100 will cause its block 110 to be moved transversely or laterally from the position depicted in FIG. 3 to that pictured in FIG. 4. Of course, any position therebetween can also be realized.

Inasmuch as vacuum-responsive devices, speed-responsive devices, and microprocessors utilized in conjunction with internal combustion engines are well-known, no need exists for detailing the construction of such devices when employed in conjunction with my apparatus. Since the apparatus is intended to be automatically controlled, in accordance with the vacuum prevailing at any given moment in the intake manifold (where my invention is used for controlling an inlet valve 36), a vacuum device 132 has been illustrated in block form, being connected to the intake manifold (not shown) of the engine 10. It can be a simple diaphragm device. Also, a speed-responsive device 130 operates in accordance with the speed of the engine 10, the camshaft 93 also being driven in accordance with the speed of the engine 10 as will become manifest hereinafter.

Extending between the vacuum device 132 and the speed-responsive device 130 is a control rod 134 having an arm 136 attached thereto so that the arm 136 moves to the left or right in unison with the control rod 134. When the arm 136 moves sufficiently to the left, it engages a switch 138 in circuit with the motor 128 which causes the shafts 100 to be rotated in a direction to shift the blocks 110 from the position in which they are shown in FIG. 2 (and FIG. 3) to the position in which one appears in FIG. 3. Conversely, when the control rod 134 is moved to the right, a switch 140 is engaged which energizes the motor 128 to cause rotation thereof in an opposite direction, thereby returning the blocks 110 from the position in which one appears in FIG. 4 to that in which it appears in FIG. 3 (and which the five blocks 110 appear in FIG. 2). The foregoing operation, in a sense, can be likened to that of a power window which conventionally can be moved into various positions, any one of which is firmly and unyieldingly maintained until the motor is energized to change the window position.

Once again, it should be taken into consideration that various intermediate positions of each block 110 can be established so that there is virtually an indeterminate number of adjusted positions that the cam shaft 93 can be shifted into.

At this stage, it is to be appreciated that when the control rod 134 is moved a sufficient distance to the left, then the cam 94 shown in FIG. 3 rides against the curved section 90 of the working surface 86 to cause the rocker arm 80 to be forced downwardly for a longer period during each rotation of the camshaft 93, because engagement between the cam 94 and the curved section 90 is maintained for a longer period of time than when the cam 94 engages the straight section 88. Consequently, the valve 36 will be open for a longer period of time; not only that, but its lift or downward travel will be increased by reason of the increased moment arm existing under this circumstance by virtue of the end 84 of the rocker arm 80 being actuated through a greater distance.

Stated somewhat differently, when the motor 128 causes the blocks 110, and also each rocker arm 80 (and 80*a*) mounted thereon, to move to the position appearing in FIG. 4, the increased opening, both as to the lift of the valve member 36 (and 36*a*) and the duration and or time in which it is maintained open is increased. Hence, the charge of mixed fuel and air that is introduced via the passage 34, and there would be one such passage 34 for each inlet valve 36, is increased and the engine 10 is supplied with more fuel for the increased load condition. This condition would be experienced in practice during, say, the acceleration of a vehicle having an engine 10 equipped with my adjusting apparatus 50.

On the other hand, when the adjusting apparatus 50 is in the relationship appearing in FIG. 3, that is with the block 110 toward the right, the valve member 36 is not opened as long because the cam lobe 98 of the cam 94 engages only the straight section 88. Hence, a lesser amount or charge of mixed fuel and air enters the combustion chamber 14 under this condition. This condition enhances the normal operation of the engine 10, such as when the vehicle is cruising. As already indicated, there are various intermediate positions that can be established for the camshaft 93, all depending upon the operating load conditions experienced at any given moment by the engine 10.

My invention permits a versatile construction and operation of the valves and the timing thereof, as will soon be described. At this point, though, it will be well to stress that the rocker arms 80 and 80*a* need not be replicas of each other. The working or follower surface 86 of the rocker arm 80*a*, although not illustrated as differing, may have a different profile from that constituting the working surface 86, the profile of which has been shown for the rocker arm 80. In this regard, it will be understood that the length of the straight section 88 on the rocker arms 80*a* may be of a different length from the section 88 on the rocker arms 80; likewise, the configurative profile of the sections 88 and 90, as shown, is susceptible to variation in order to adapt the rocker arm 80 to the valve requirements of the particular engine 10 with which my apparatus is to be incorporated. The foregoing is especially pertinent to the description of FIGS. 5–11, hereinafter presented.

From FIGS. 1 and 2, it will be observed that the camshaft 93 has a timing gear 142 thereon (shown as a pulley in FIG. 1). As can be seen from FIG. 1, the crankshaft, only an end of which is shown, has a timing gear 144 thereon (shown only in FIG. 1 and depicted as a pulley). Inasmuch as the camshaft 93 is to rotate at half the speed of the crankshaft 28, as is customary, the gear 142 would have twice as many teeth as the gear 144. Although teeth are not shown in FIG. 1, an effort has been made to illustrate the reduction by reason of the different diameters of the elements 142, 144.

Although the timing gears 142, 144 (or sprockets or pulleys) are conventional, it is believed that my timing mechanism denoted generally by the reference numeral 150 is novel. Although the belt indicated by the numeral 152 could be a chain, the drawing is simplified somewhat by showing a belt (and the members 142, 144 as pulleys).

The timing mechanism 150, as exemplified in FIG. 1, includes the timing belt 152 that is only diagrammatically shown. It will be noted, however, that the belt 152 passes about the upper timing gear or pulley 142 on the camshaft 93, the gear being shown as simply a pulley for drafting simplicity as already indicated, and also about the timing gear or pulley 144 on the crankshaft 28, the crankshaft gear 144 also being shown merely as a pulley. In order to take up any slack, an idler pulley 154 (a gear or sprocket in practice) is at the left, being rotatably carried at the upper ends of a pair of pivotal arms 156, there being a pin 158 that rotatably journals the pulley 154. The lower ends of the arms 156 are pivotally mounted with respect to the cylinder block 12 of the engine 10 by virtue of a pivot pin 160.

Made use of in effecting an adjustment in the timing, the camshaft 93 has a stub portion **93*a* projecting beyond the face of the gear or pulley 142. The stub portion 93*a* has a sleeve bearing 162 encircling same. Secured to the sleeve bearing 162 and projecting radially therefrom in a horizontal direction is a rod 164 that has an electric motor 166 attached thereto. The electric motor 166 has a shaft 168 projecting from the end thereof opposite from the end attached to the rod 164, the shaft 168 having a threaded end portion 170 received in tapped hole 172 extending diametrically through a cylindrical boss 174 that is pivotally attached to one side of a vertical arm 176, the boss 174 being mounted intermediately the ends of this arm 176 at 178, such as by means of a shoulder bolt (not visible) extending through a hole (not visible) in the arm 176 from the far side thereof into the boss 174. The lower end of the vertical arm 176 is pivotally mounted to the cylinder block 12 of the engine 10 by means of a pivot pin 180 and a tubular spacer 182. The upper end of the arm 176 carries an adjusting pulley 184 that is rotatably mounted on a pin 186 projecting from the opposite side of the vertical arm 176 from that which the boss 174** projects.

It should be obvious from FIG. 1 that when the motor 166 is energized so as to rotate the threaded shaft 168 in one direction, the arm 176 is swung about its pivot pin 180 in either a clockwise or counterclockwise direction. When swung in a clockwise direction, it is apparent that the gear or pulley 142 on the camshaft 93 is angularly shifted in a clockwise direction with respect to the gear or pulley 144 on the crankshaft 28, thereby retarding the valve action with respect to the crankshaft 28, which is rotating in a counterclockwise direction, as is conventional. When the motor 166 is energized to cause its shaft 168 to rotate in an opposite direction, then the arm 176 is rocked in a counterclockwise direction to advance the timing action.

In a number of instances one would rely solely on the shifting of the camshaft 93 to change the valve timing. To do this a fixed pin **93*b* attached to the cylinder block 12 would be used with the sleeve bearing 162 placed on the fixed pin 93*b*. This would fixedly locate the pulley 184 so that the valve timing would be automatically changed as the camshaft 93 is shifted by the motor 128**.

Having presented the foregoing description, it will now be easier to understand the method illustrated in FIGS. 5–11. The applicant can think of no better succinct term than "five-cycle" operation in contradistinction to the usual "four-cycle" operation. It is important, however, to recognize that my invention permits an engine equipped with my valve operating mechanism to be operated in the so-called "four-cycle" mode, as well as the "five-cycle" mode, depending upon the load to which the engine 10 is subjected at any given time. More specifically, my method enables the five-cycle operation to become effective during lighter load conditions and progressively continuing toward a four-cycle operational mode when a full load engine operation is required. Stated somewhat differently, a lesser charge of fuel and air enters each cylinder or combustion chamber 14 of the engine 10 during the five-cycle operation, the amount of inducted charge increasing progressively to accommodate for the increasing load on the engine, the five-cycle operation changing completely to the conventional four-cycle when full load is reached.

Before describing FIGS. 5–11 in detail, it can be explained that the five-cycle mode may be described as including the following sequence: (1) intake, (2) expansion, (3) compression, (4) power, and (5) exhaust in contrast to the usual: (1) intake, (2) compression, (3) power, and (4) exhaust for conventionally designed valve mechanisms. It will also be beneficial to point out that, in practice, intake and exhaust valves do not open and close precisely at the top and bottom dead center positions. The reasons for this are well understood. Typically, inlet valves open 7 degrees or so prior to the piston reaching top dead center preparatory to the beginning of the customary intake stroke, closing perhaps 45 degrees after bottom dead center on the compression stroke. Exhaust valves on the other hand, may well open 50 degrees before bottom dead center of the piston or the power stroke, remaining open during the exhaust stroke, and finally closing, say, 9 degrees after top dead center on the usual intake stroke. The valve overlap can be on the order of 16 degrees with respect to the opening of intake valves prior to the closing of the exhaust valves on an internal combustion engine. Angle values, such as those alluded to above, may be realized with my invention, certain of them being controlled so as to improve the fuel efficiency of an internal combustion engine when equipped with my apparatus 50. It will facilitate the ensuing description, however, to consider the opening and closing of the inlet and exhaust valve 36 and **36*a*, respectively, as coincidently occurring at top and bottom dead center positions of the piston 16**.

Figure 5:
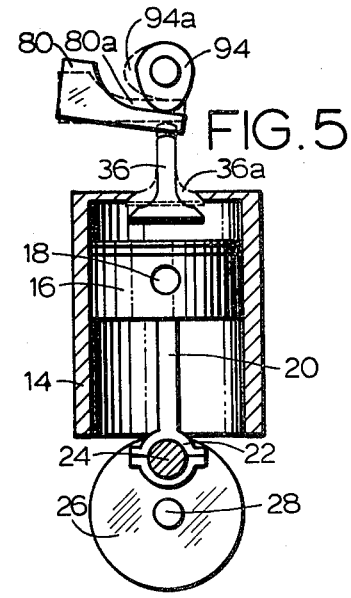
FIG. 5 is a sectional view of one of the cylinders contained in the engine of FIG. 1 with the open inlet valve shown in solid outline and the closed exhaust valve shown in phantom outline, the view depicting the beginning of an intake stroke.

Referring now to FIG. 5, and remembering that the valve 36, shown in solid outline, represents an inlet valve, and that the valve **36*a*, shown in phantom outline, represents an exhaust valve, the top dead center position of FIG. 5 depicts the start of an intake stroke, the inlet valve 36 being open and the outlet valve 36*a*** being closed.

Figure 6:
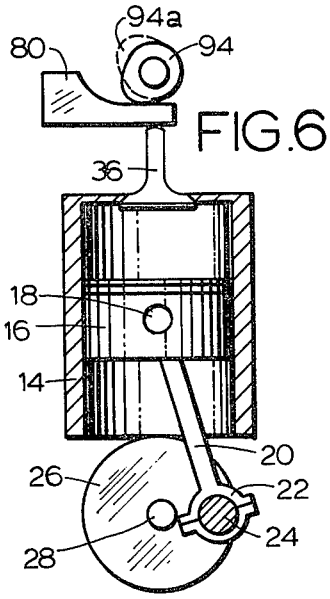
FIG. 6 shows the piston of FIG. 5 descending but with both valves closed.

FIG. 6 shows the ending of the inlet stroke begun in FIG. 5, and the initiation of the expansion stroke available when practicing my invention. It will be perceived that both valves 36, **36*a* are now closed and that the camshaft 93 remains in the same lateral position as in FIG. 5. It should be evident that the piston 14, having moved only partway down in the cylinder 14 has drawn in a lesser charge of fuel and air than had the piston 16 traveled the full vertical length of the cylinder 16 with the inlet valve 36 open during such full travel of the piston 16, that is, from its top dead center position to its bottom dead center position. The lesser charge would be required under light load conditions, and hence the desirability of effecting the early closing of the inlet valve 36 as illustrated in FIG. 6**.

Figure 6A:
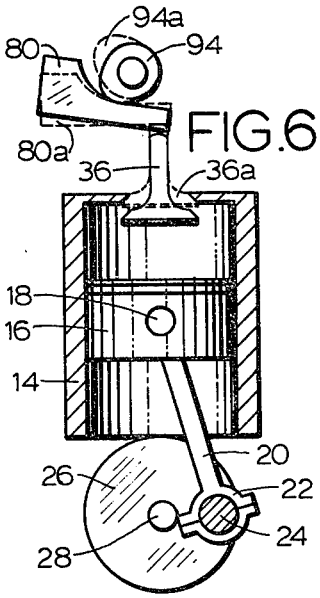
FIG. 6A is a view corresponding to FIG. 6 but with the exhaust valve still closed and the inlet valve still open instead of being closed as in FIG. 6 in order to permit a greater charge of fuel and air to be drawn into the cylinder than that inducted in FIG. 6.
Figure 7:
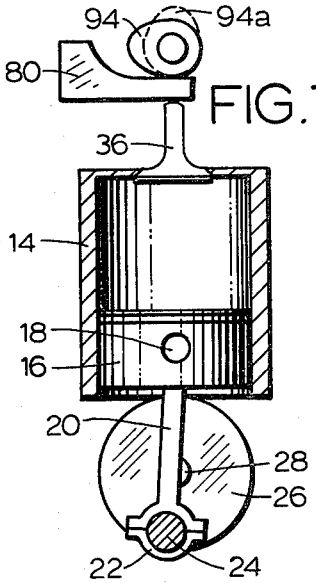
FIG. 7 is a view showing the piston after it has moved to bottom dead center from the intermediate position of FIG. 6, but valves now being closed.
Figure 7A:
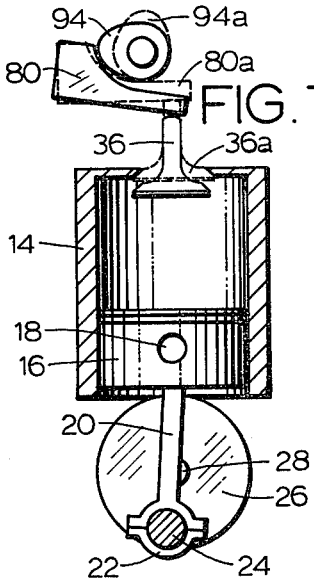
FIG. 7A shows the completion of the piston movement of FIG. 6A, the exhaust valve remaining closed and the inlet valve about to close.

A greater charge would be required under heavier loads, particularly full load, and the capability of supplying more fuel and air when so needed is portrayed in FIG. 6A (and FIG. 7A). In FIG. 6A it is to be observed that the inlet valve 36 is still open, this being by virtue of the camshaft 93 having been shifted to the left in this figure from the position shown in FIG. 6 (and FIG. 5).

Consequently, when the piston 16 continues downwardly from the intermediate position of FIG. 6 to the bottom dead center position shown in FIG. 7, no more fuel/air is inducted into the cylinder 14, for the inlet valve 36 remains closed during this period. This is what has been termed the "expansion" stroke because the mixture that has been drawn in experiences a vacuum or subatmospheric pressure during this latter portion of the downward travel of the piston 16. By contrast, though, the travel of the piston 16 from its intermediate position appearing in FIG. 6A to its bottom dead center position of FIG. 7A, draws in a full charge of fuel and air, for the camshaft 93 remains in its leftward position and the cam 94 keeps the valve 36 open by engaging the curved section 90, whereas in FIGS. 5, 6 and 7 only the straight section 88 is engaged.

Obviously, the camshaft 93 can be shifted to positions in between those shown in FIGS. 5, 6, 7, and those shown in FIGS. 6A, 7A, thereby accommodating a range of load conditions. As an example, the inlet valve 36 could be kept open until the piston 16 had completed 75% of its downward travel rather than the 50% shown in FIG. 6 (and FIG. 6A). In other words the camshaft 93 is adjustably shifted to open and close the inlet valve 36 at the best time in order to effect an optimum, and hence more efficient, supply of fuel and air to the cylinder 14. Thus, with my invention the intake stroke is varied to suit the load conditions at any given time; by the same token the decompression stroke is correspondingly varied. One is increased as the other is decreased, all as the piston 16 moves from top dead center to bottom dead center.

Figure 8:
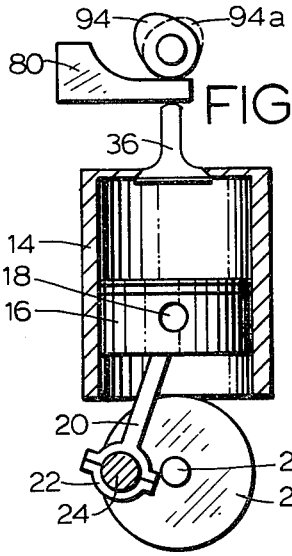
FIG. 8 depicts the compression stroke in progress, both valves being closed.
Figure 9:
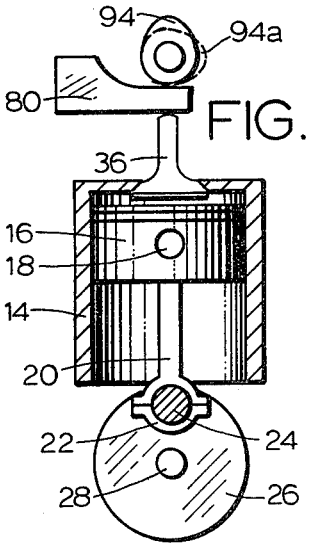
FIG. 9 depicts the completion of the compression stroke and the beginning of the power stroke, both valves still being closed at this time.
Figure 10:
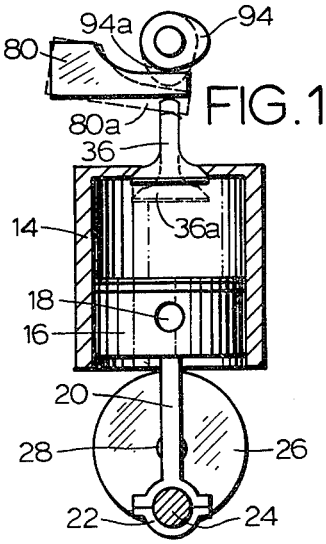
FIG. 10 shows the ending of the power stroke and the beginning of the exhaust stroke, the phantom exhaust valve being open.
Figure 11:
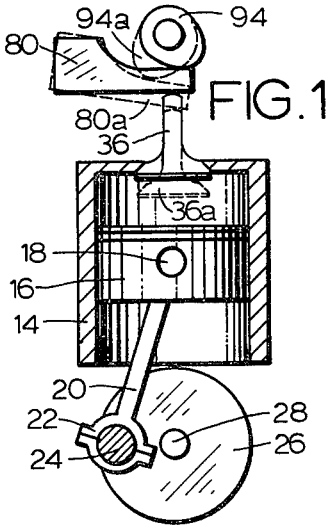
FIG. 11 shows the exhaust stroke in progress, the exhaust valve still being open.

Once bottom dead center is reached, as illustrated in FIGS. 7 and 7A, the piston 16 starts to move upwardly, thereby initiating the compression stroke occurring in FIG. 8. Of course, both valves 36, **36*a* are closed during this upward movement of the piston 16. The compression stroke is completed when the piston 16 again reaches top dead center, as illustrated in FIG. 9. FIG. 9 also represents the start of the power stroke with FIG. 10 depicting the completion of the power stroke and FIG. 11 shows the piston 16 in the process of again moving upwardly, this being during the exhaust stroke with the valve 36*a* open. It is not deemed necessary to depict the camshaft position of FIGS. 6A and 7A as it would appear when corresponding to FIGS. 5, 8, 9, 10 and 11; the cam 94 would still be engaging the straight section 88 and the valve 36 would be actuated very similarly as in these FIGS. 5, 8, 9, 10 and 11**, but only with an increased lift.

Recapitulating for a moment it might be well to point out that the sum of the intake and decompression stroke corresponds to the conventional intake stroke, as customarily considered when describing the operation of the usual four-cycle engine. My compression, power and exhaust strokes correspond to those of a four-cycle engine. It is the ability to shift in a relative manner the camshaft 93 with respect to the rocker arm 80 that enables the five-cycle method constituting my invention to be realized. Consequently, under light loads the camshaft 93 would remain in the position in which it is illustrated in FIGS. 5, 6, 7, 8, 9, 10 and 11, whereas under a heavier or full load, the camshaft would first be shifted to the left, as shown in FIGS. 6A and 7A, remaining in this shifted position as long as the increased or full load continues.

I claim:

1. A timing mechanism for internal combustion engines having a camshaft, a timing gear member mounted on said camshaft, a crankshaft and a timing gear member mounted on said crankshaft, and endless belt means entrained about said timing gear members, said mechanism comprising means for directing a portion of said endless belt means in a direction generally perpendicular to a line extending between said camshaft and said crankshaft, said directing means including an additional gear member and said endless belt means being entrained about said timing gear members and said additional gear member, threaded means for shifting said directing means to effect a differential angular movement between said timing gear members, idler means for maintaining said endless belt means taut as said additional gear member is shifted, a pivotal arm, said additional gear member being mounted at one end of said pivotal arm, means mounting the other end of said arm for pivotal movement, means engaging an intermediate portion of said pivotal arm for effecting angular movement of said arm to produce said differential angular movement of said timing gear members, said means for angularly pivoting said arm including a motor, a threaded shaft drive extending from one end of said motor, said arm having a member thereon for threadedly receiving a portion of said threaded shaft so that said threaded shaft when rotated by its motor will cause said arm to be pivotally moved, a rod fixedly connected at one end to the other end of said motor, and a bearing encircling a portion of said camshaft, the other end of said rod being connected to said bearing.

2. Apparatus for operating a valve of an internal combustion engine having a reciprocable valve member for opening and closing a valve port in communication with a combustion chamber of the engine, the apparatus comprising a rocker arm, means mounting one end of said rocker arm for pivotal movement about a fixed axis so that the other end of said rocker arm acts against said valve member, a camshaft, a cam on said camshaft engageable with said rocker arm, and means for shifting said camshaft relative to said fixed axis so that said cam is engageable with various longitudinal portions of said rocker arm between its said other end and its said one end, said shifting means including bearing means for rotatably supporting said camshaft and means threadedly engaging said bearing means for moving said bearing means to effect said shifting of said camshaft relative to said axis.

3. Apparatus in accordance with claim 2 in which said rocker arm has a straignt section extending from its said other end toward its said one end to provide at least some of said various longitudinal portions of said rocker arm.

4. Apparatus in accordance with claim 3 in which said rocker arm has a curved section extending from its said one end toward its said other end to provide at least some of said various longitudinal portions of said rocker arm.

5. Apparatus in accordance with claim 3 in which said rocker arm has a working surface against which said cam bears, said working surface including a straight section extending partway from its said other end toward its said one end and said working surface including a curved section extending from said one end of said rocker arm to said straight section.

6. Apparatus in accordance with claim 5 including a shaft, said shaft providing said fixed axis.

7. Apparatus in accordance with claim 6 in which said shaft is tubular.

8. Apparatus in accordance with claim 7 including additional rocker arms, each being mounted at one end for pivotal movement about said tubular shaft, said camshaft having a cam for each of said rocker arms, so that when said camshaft is shifted, the cams thereon are correspondingly shifted relative to said tubular shaft and relative to all of said rocker arms.

9. Apparatus in accordance with claim 2 including means for journaling said threaded shaft for rotation about an axis perpendicular to said rocker arm axis.

10. Apparatus in accordance with claim 9 in which one end of said threaded shaft has a pulley thereon, and means for rotating said pulley in accordance with the load to which the internal combustion engine is subjected.

11. Apparatus in accordance with claim 10 including a piston reciprocably disposed in said combustion chamber, a crankshaft for reciprocably moving said piston within said chamber, and means for effecting an angular shifting of said camshaft in relation to said crankshaft so as to change the timing of said valve member with respect to the movement of said crankshaft and piston.

12. Apparatus in accordance with claim 11 including a timing pulley on said camshaft and a timing pulley on said crankshaft, endless belt means entrained about said timing pulleys, and an additional pulley in engagement with said endless belt means for directing a portion of said timing belt in a direction generally perpendicular to a line extending between the camshaft and said crankshaft, and means for shifting said additional pulley so as to effect a relative angular displacement between said timing pulleys and to effect the timing of said valve member with respect to the movement of said crankshaft and piston.

13. Apparatus in accordance with claim 12 in which said means for shifting said additional pulley includes an arm, said additional pulley being pivotally mounted at one end of said arm, means pivotally supporting the other end of said arm, and means for maintaining said arm in a substantially vertical relation.

14. Apparatus in accordance with claim 13 in which said means for shifting said additional pulley includes means for angularly moving said substantially vertical arm to shift said additional pulley and thus change said timing.

15. Apparatus in accordance with claim 14 in which said last-mentioned means includes a motor for changing the angular position of said arm.

16. Apparatus in accordance with claim 15 including a rod, a bearing encircling one end of said camshaft, one end of said rod being attached to said bearing and the other end of said rod being attached to said motor, said motor including a threaded drive shaft rotated by said motor, a member carried on said arm, said threaded shaft being threadedly engaged with said member on said arm, whereby the distance said threaded shaft is extended or retracted with respect to said motor will cause said arm to angularly move and thereby cause said additional pulley or gear to change said timing.

17. Apparatus in accordance with claim 16 including idler means for maintaining said endless belt means taut.

* * * * *